US011204031B2

(12) United States Patent
Duncan et al.

(10) Patent No.: US 11,204,031 B2
(45) Date of Patent: Dec. 21, 2021

(54) TOLERANCE INDEPENDENT CRESCENT INTERNAL GEAR PUMP

(71) Applicant: CIRCOR PUMPS NORTH AMERICA, LLC, Monroe, NC (US)

(72) Inventors: Patrick Wilson Duncan, Marchville, NC (US); Colette Doll Greene, Mint Hill, NC (US); Philip Taylor Alexander, Matthews, NC (US)

(73) Assignee: CIRCOR PUMPS NORTH AMERICA, LLC, Monroe, NC (US)

( * ) Notice: Subject to any disclaimer, the term of this patent is extended or adjusted under 35 U.S.C. 154(b) by 120 days.

(21) Appl. No.: 16/682,250

(22) Filed: Nov. 13, 2019

(65) Prior Publication Data

US 2020/0102952 A1 Apr. 2, 2020

Related U.S. Application Data

(62) Division of application No. 15/548,296, filed as application No. PCT/US2015/014565 on Feb. 5, 2015, now Pat. No. 10,514,032.

(51) Int. Cl.
*F03C 2/00* (2006.01)
*F03C 4/00* (2006.01)
(Continued)

(52) U.S. Cl.
CPC ..... *F04C 2/101* (2013.01); *F04C 2/102* (2013.01); *F04C 15/0019* (2013.01);
(Continued)

(58) Field of Classification Search
CPC ..... F04C 2/086; F04C 2/101; F04C 2/102; F04C 2230/10; F04C 2230/60;
(Continued)

(56) References Cited

U.S. PATENT DOCUMENTS 2,349,022 A * 5/1944 Ungar ..... F04C 2/101 418/170
2,433,360 A 12/1947 Haight
(Continued)

FOREIGN PATENT DOCUMENTS

| | | | | |
|---|---|---|---|---|
| CN | 202370833 U | | 8/2012 | |
| GB | 1438917 A | * | 6/1976 | ..... F01C 1/102 |
| JP | 2000145658 A | | 5/2000 | |

OTHER PUBLICATIONS

International Search Report and Written Opinion dated Oct. 13, 2015 for PCT/US2015/014565.

*Primary Examiner* — Theresa Trieu
(74) *Attorney, Agent, or Firm* — Kacvinsky Daisak Bluni PLLC

(57) ABSTRACT

A crescent internal gear pump includes a front cover, an end cover, a ring gear and a pinion gear disposed within a gear housing in an eccentric, intermeshing relationship. The housing is disposed intermediate the front cover and the end cover. A crescent is disposed radially intermediate the ring gear and the pinion gear. The crescent partially extends into a correspondingly shaped slot in the end cover. The gear housing, the ring gear, and the pinion gear can have substantially the same thickness. A shim can be disposed intermediate the end cover and the gear housing for establishing a desired clearance therebetween.

9 Claims, 6 Drawing Sheets

(51) Int. Cl.

| | |
|---|---|
| ***F04C 18/00*** | (2006.01) |
| ***F04C 2/00*** | (2006.01) |
| ***F04C 2/10*** | (2006.01) |
| ***F04C 15/00*** | (2006.01) |

(52) U.S. Cl.
CPC ..... *F04C 2230/10* (2013.01); *F04C 2230/60* (2013.01); *F04C 2230/602* (2013.01)

(58) Field of Classification Search
CPC ..... F04C 2230/602; F04C 15/0019; F04C 23/008; B23F 15/08; Y10T 29/49242
See application file for complete search history.

(56) References Cited

U.S. PATENT DOCUMENTS

| | | | |
|---|---|---|---|
| 3,907,470 | A | 9/1975 | Harle et al. |
| 5,674,060 | A | 10/1997 | Buchmueller et al. |
| 6,672,850 | B2 | 1/2004 | Palazzolo et al. |
| 2014/0255235 | A1 | 9/2014 | Duncan et al. |

* cited by examiner

TOLERANCE INDEPENDENT CRESCENT INTERNAL GEAR PUMP

CROSS-REFERENCE TO RELATED APPLICATION

This application is a divisional of, and claims priority to, U.S. application Ser. No. 15/548,296 filed on Aug. 2, 2017, which is a national stage application filed under 35 U.S.C. § 371 of International Application No. PCT/US2015/014565, filed Feb. 5, 2015, which applications are incorporated by reference herein in their entireties.

FIELD OF THE DISCLOSURE

The disclosure relates generally to the field of gear pumps, and more particularly to an efficient crescent internal gear pump that can be manufactured without applying strict tolerances to individual components of the pump.

BACKGROUND OF THE DISCLOSURE

Conventional crescent internal gear pumps typically include rotatably driven, intermeshing ring and pinion gears that are disposed in an eccentric relationship within a cylindrical gear housing. The ring gear, pinion gear, and the housing are sandwiched between a front cover and an end cover. A crescent is disposed radially intermediate the pinion gear and the ring gear. During operation of the pump, the ring and pinion gears are rotatably driven, and fluid from a fluid inlet in the gear housing is entrained within expanding gaps between the teeth of the ring and pinion gears and the crescent. As the ring and pinion gears continue to rotate, the gaps shrink and the entrained fluid is forced to exit the gear housing through a fluid outlet.

A disadvantage that is commonly associated with crescent internal gear pumps of the type described above is that the efficiency of such a pump is highly dependent on the precision of clearances between the components of the pump. For example, pump efficiency is influenced by the sizes of clearances between the faces of the ring and pinion gears and the faces of the front and end covers, and also by the presence and size of gaps between the end of the crescent and the front cover. Ideally, no gap would exist between the end of the crescent and front cover.

In common practice, the tight tolerances that are required in conventional crescent internal gear pumps are achieved using precise machining or even manual hand lapping. This drives manufacturing to use very expensive machines and machining techniques. Often, it also requires that components be sorted in a time-consuming, laborious manner in order to identify combinations of components that achieve desired relative clearances. Still further, individual components must generally be held to tolerances in excess of what is required for a particular component in order to account for tolerance stack-up when the components are assembled.

In view of the foregoing, it would be advantageous to provide an efficient crescent internal gear pump that can be manufactured without applying strict tolerances to individual components of the pump.

SUMMARY

An exemplary tolerance independent crescent internal gear pump in accordance with an embodiment of the present disclosure may include a front cover, an end cover, a ring gear and a pinion gear disposed within a gear housing in an eccentric, intermeshing relationship, the housing being disposed intermediate the front cover and the end cover, and a crescent disposed radially intermediate the ring gear and the pinion gear, the crescent partially extending into a complementary slot in the end cover. The gear housing, the ring gear, and the pinion gear may have substantially the same thickness. The exemplary tolerance independent crescent internal gear pump may further include a shim disposed intermediate the end cover and the gear housing for establishing a desired clearance therebetween.

An exemplary method of manufacturing a tolerance independent crescent internal gear pump in accordance with an embodiment of the present disclosure may include forming a gear housing, a ring gear, a pinion gear, a front cover, and an end cover as separate components, wherein the crescent is formed with a length that is greater than thicknesses of the gear housing, the ring gear, and the pinion gear. The method may further include match grinding the gear housing, the ring gear, and the pinion gear to substantially the same thickness. The method may further include partially inserting the crescent into a complementary slot in the end cover, wherein a length of a portion of the crescent that protrudes from the slot is greater than the thicknesses of the gear housing, ring gear, and pinion gear. The method may further include preliminarily assembling the gear housing, the ring gear, the pinion gear, the front cover, and the end cover using mechanical fasteners, whereby a front face of the crescent is brought into engagement with the front cover. The method may further include tightening the mechanical fasteners to draw the gear housing, the ring gear, the pinion gear, the front cover, and the end cover into secure longitudinal engagement with one another, whereby the front cover forcibly drives the crescent further into the slot.

DETAILED DESCRIPTION

Figure 1:
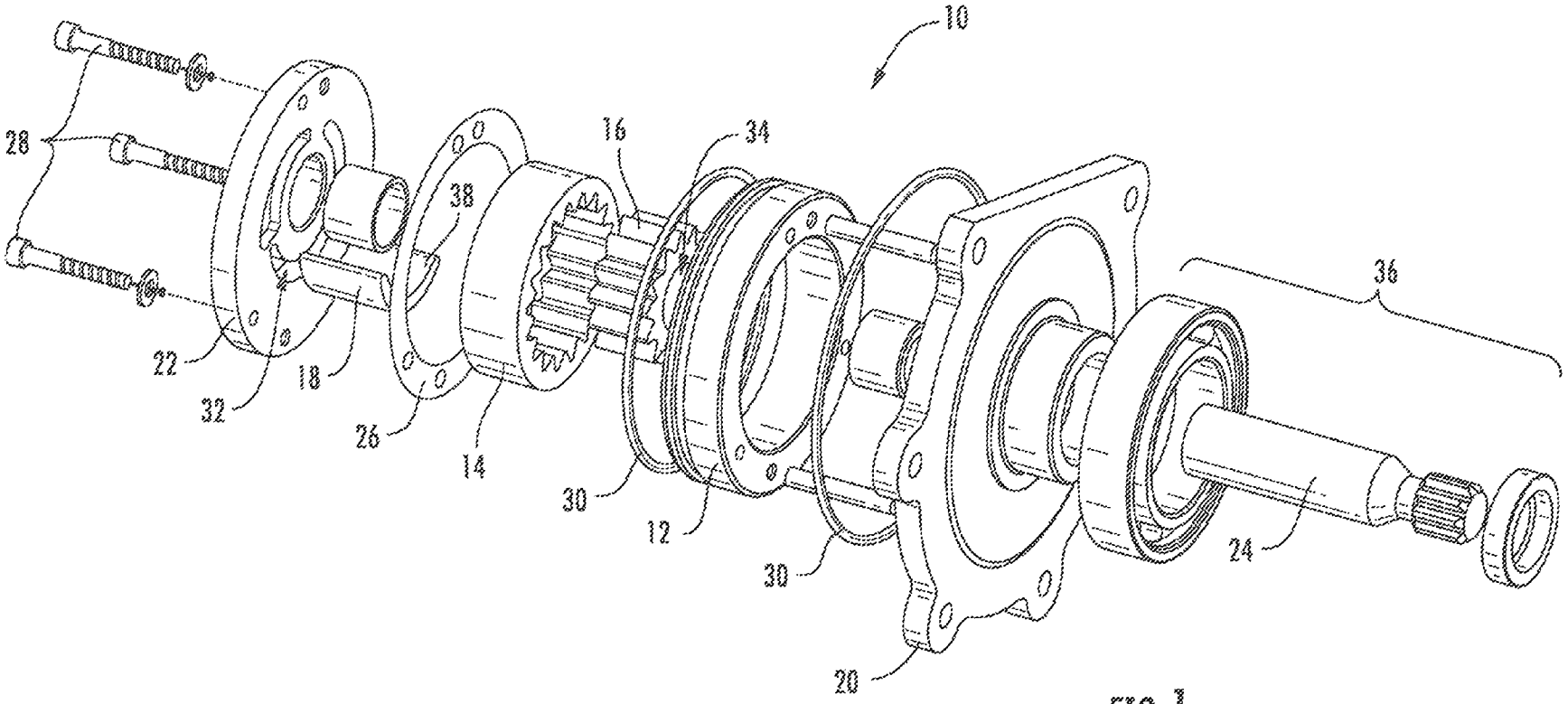
FIG. 1 is an exploded view illustrating an exemplary tolerance independent crescent internal gear pump in accordance with an embodiment of the present disclosure.

An apparatus and method in accordance with the present disclosure will now be described more fully hereinafter with reference to the accompanying drawings, in which preferred embodiments of the device are shown. The apparatus and method, however, may be embodied in many different forms and should not be construed as being limited to the embodiments set forth herein. Rather, these embodiments are provided so that this disclosure will be thorough and complete, and will fully convey the scope of the apparatus and method to those skilled in the art. In the drawings, like numbers refer to like elements throughout.

Referring to FIG. 1, an exemplary embodiment of a crescent internal gear pump 10 (hereinafter "the pump 10") in accordance with the present disclosure is shown. For the sake of convenience and clarity, terms such as "front," "rear," "radial," "axial," "lateral," and "longitudinal" will be used herein to describe the relative placement and orientation of the pump 10 and its various components, each with respect to the geometry and orientation of the pump 10 as it appears in FIG. 1. Particularly, the left side of the pump 10 in FIG. 1 shall be referred to as the "front" of the pump 10, and the right side of the pump 10 in FIG. 1 shall be referred to as the "rear" of the pump 10. The terms "length" and "thickness" shall be used interchangeably herein to refer to the dimension of various components of the pump 10 in the front-to-rear, or longitudinal, direction. The aforementioned terminology will include the words specifically mentioned, derivatives thereof, and words of similar import.

The pump 10 may generally include a gear housing 12, a ring gear 14, a pinion gear 16, a crescent 18, a front cover 20, an end cover 22, a drive shaft 24, and a shim 26. The pump 10 may further include various mechanical fasteners 28 for holding the components of the pump 10 together, as well as various sealing rings 30 for establishing fluid-tight junctures between the components of the pump 10.

Figure 3:
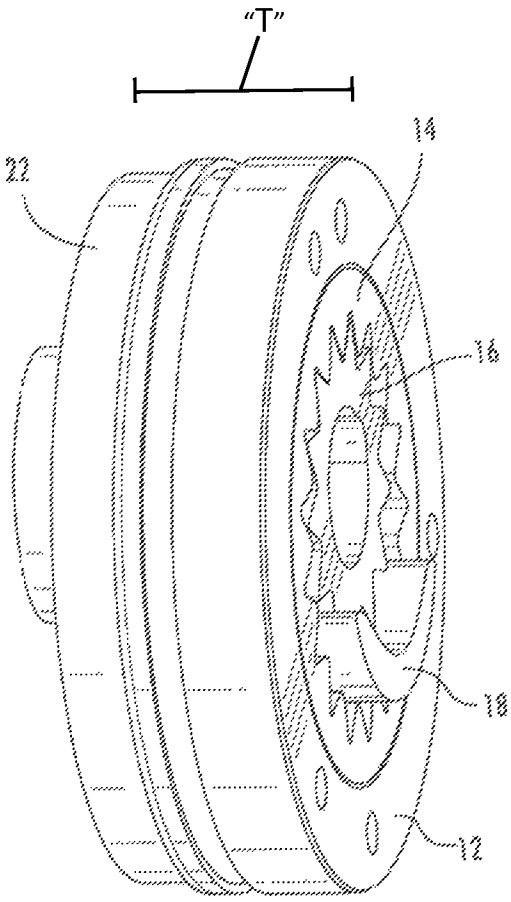
FIG. 3 is an isometric view illustrating the gear housing, ring gear, and pinion gear, and crescent of the exemplary pump shown in FIG. 1.
Figure 2:
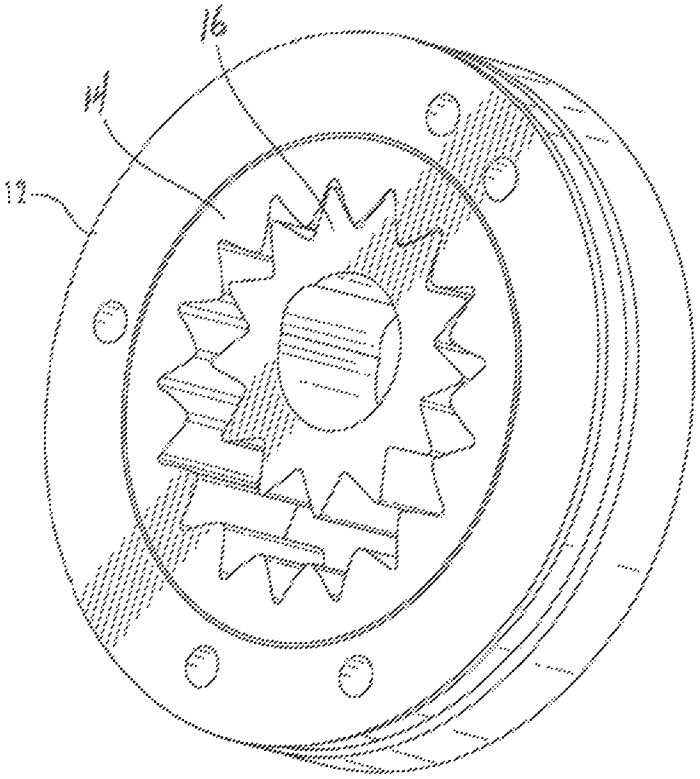
FIG. 2 is an isometric view illustrating the gear housing, ring gear, and pinion gear of the exemplary pump shown in FIG. 1.

The ring gear 14 and pinion gear 16 of the pump 10 may be disposed within the gear housing 12 in an eccentric, radially intermeshing relationship (as best shown in FIG. 2) that will be familiar to those of ordinary skill in the art. The crescent 18 may be disposed radially intermediate the ring gear 14 and the pinion gear 16 (as best shown in FIG. 3), and may also extend longitudinally into fluid-tight, press-fit engagement with a crescent-shaped slot 32 in the end cover 22 as further described below. A rear end of the drive shaft 24 may extend through a central bore 34 in the pinion gear 16 and may radially engage the pinion gear 16 such that rotation of the drive shaft 24 about its longitudinal axis may rotatably drive the pinion gear 16 about its longitudinal axis. A front end of the drive shaft 24 may be supported by a bearing and seal arrangement 36.

Figure 4:
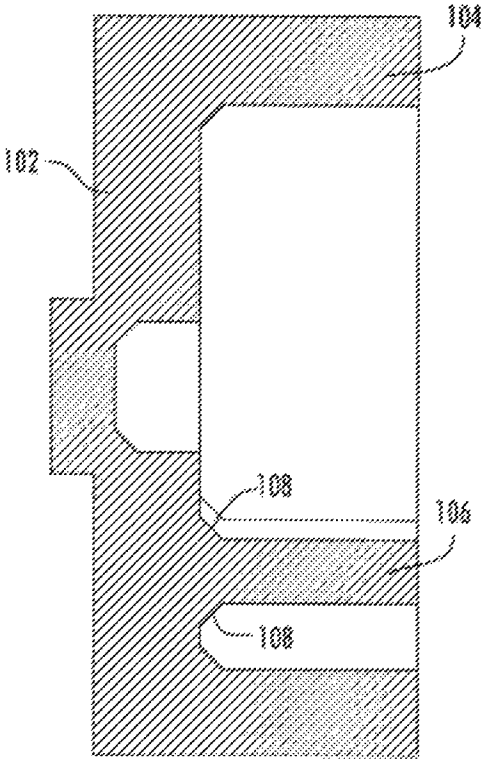
FIG. 4 (PRIOR ART)
FIG. 4 is a cross-sectional side view illustrating a crescent plate of a conventional crescent internal gear pump.

As shown in FIG. 1, the crescent 18 may be entirely separate from (i.e., not integral with) the other components of the pump 10 and may extend into the crescent-shaped slot 32 in the end cover 22 when the pump 10 is assembled. This configuration may provide a number of distinct advantages relative to conventional crescent internal gear pump designs. For example, referring to FIG. 4, a cross-sectional side view of an end cover 102, a gear housing 104, and a crescent 106 of a conventional crescent internal gear pump is shown. These components are commonly collectively referred to as a "crescent plate," and are typically machined from a single piece of material as depicted in FIG. 4. Due to tooling limitations, a small radius or angled transition 108 is typically formed at the juncture of the crescent 106 and the end cover 102 when the crescent plate is machined. Thus, the ring and pinion gears (not shown) that are employed in conjunction with such a crescent plate must be formed with complementary, chamfered edges to accommodate the radius 108 in order to provide sufficient clearance when the ring and pinion gears are operatively disposed immediately adjacent the end cover 102. This requires additional manufacturing steps, and also creates leak paths in the pump that may degrade pump efficiency.

Figure 5A:
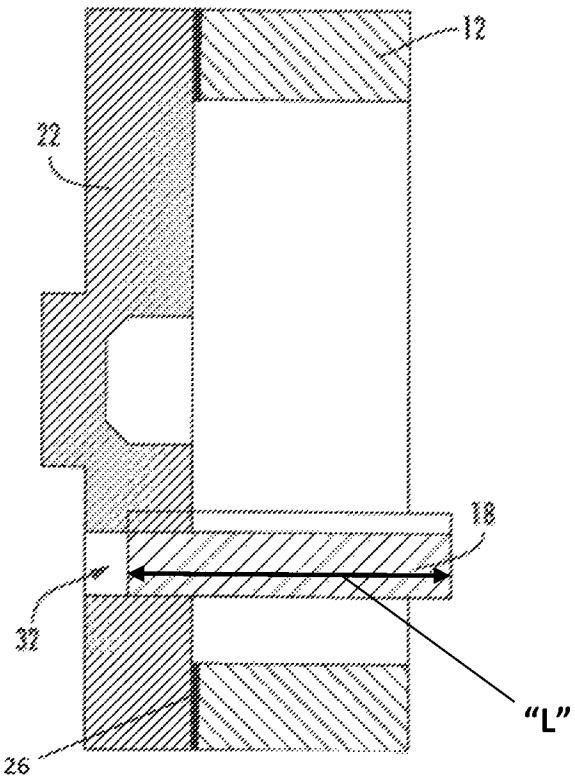
FIG. 5A is a cross-sectional side view illustrating the end cover, shim, crescent, and gear housing of the exemplary pump shown in FIG. 1.

Unlike conventional crescent internal gear pumps, the pump 10 does not have a one-piece crescent plate. Instead, the end cover 22, gear housing 12, and crescent 18 of the pump 10 are independent components, and the crescent 18 fits into the complementary, crescent-shaped slot 32 in the end cover 22. Thus, as shown in FIG. 5A, the juncture of the crescent 18 and the end cover 22 forms a sharp 90-degree angle without a radius or angled transition that is normally created when such a juncture is machined from a single piece of material. Resultantly, the edges of the ring and pinion gears 14, 16 of the pump 10 do not have to be chamfered to provide sufficient clearance for the juncture of the crescent 18 and end cover 22. This reduces manufacturing steps, and therefore cost, relative to conventional crescent internal gear pumps. Additionally, the leak paths that are created when the edges of ring and pinion gears are chamfered are avoided, thereby improving the efficiency of the pump 10 relative to conventional crescent internal gear pumps.

The configuration of the pump 10 may provide a further advantage relative to conventional crescent internal gear pumps having one-piece crescent plates. Particularly, in order to eliminate or minimize the clearance between a crescent and a front cover of a conventional crescent internal gear pump (which is important for optimizing pump efficiency), the length of the crescent and a gear housing of such a pump must be machined to very precise tolerances so that the front cover is not held apart from the crescent by the gear housing. Furthermore, in order to achieve optimal clearance between the end cover and the ring and pinion gears of a conventional crescent internal gear pump, the length or thickness of the gear housing and the ring and pinion gears must be machined to very precise tolerances. Such precise machining may be costly, time consuming, and may require numerous, complicated manufacturing steps, which may include manual lapping.

In contrast to the configuration of conventional crescent internal gear pumps, the detached crescent 18 of the pump 10 is an independent component that can be longitudinally pressed into the crescent-shaped slot 32 of the end cover 22 as described above. Thus, with regard to the relative lengths of the crescent 18 and the gear housing 12, the precise length "L" of the crescent 18 (FIG. 5A) is not critical as long as the crescent 18 is slightly longer (e.g., several thousands of an inch longer) than the gear housing 12. Particularly, when the components of the pump 10 are preliminarily fit together during assembly, a rear end of the crescent 18 may be partially seated within the crescent-shaped slot 32 and a front face 38 of the crescent 18 may engage the front cover 20. Subsequently, when the fasteners 28 are tightened and the components of the pump 10 are drawn into secure engagement with one another, the front cover 20 may force the crescent 18 further into the crescent-shaped slot 32 until the fasteners 28 are fully tightened. Thus, when the pump 10 is completely assembled, the front face 38 of the crescent 18 may be disposed in firm engagement with the front cover 20 with no clearance therebetween. Again, this configuration may be achieved without having to machine the lengths of the gear housing 12 or the crescent 18 to precise tolerances.

Figure 6:
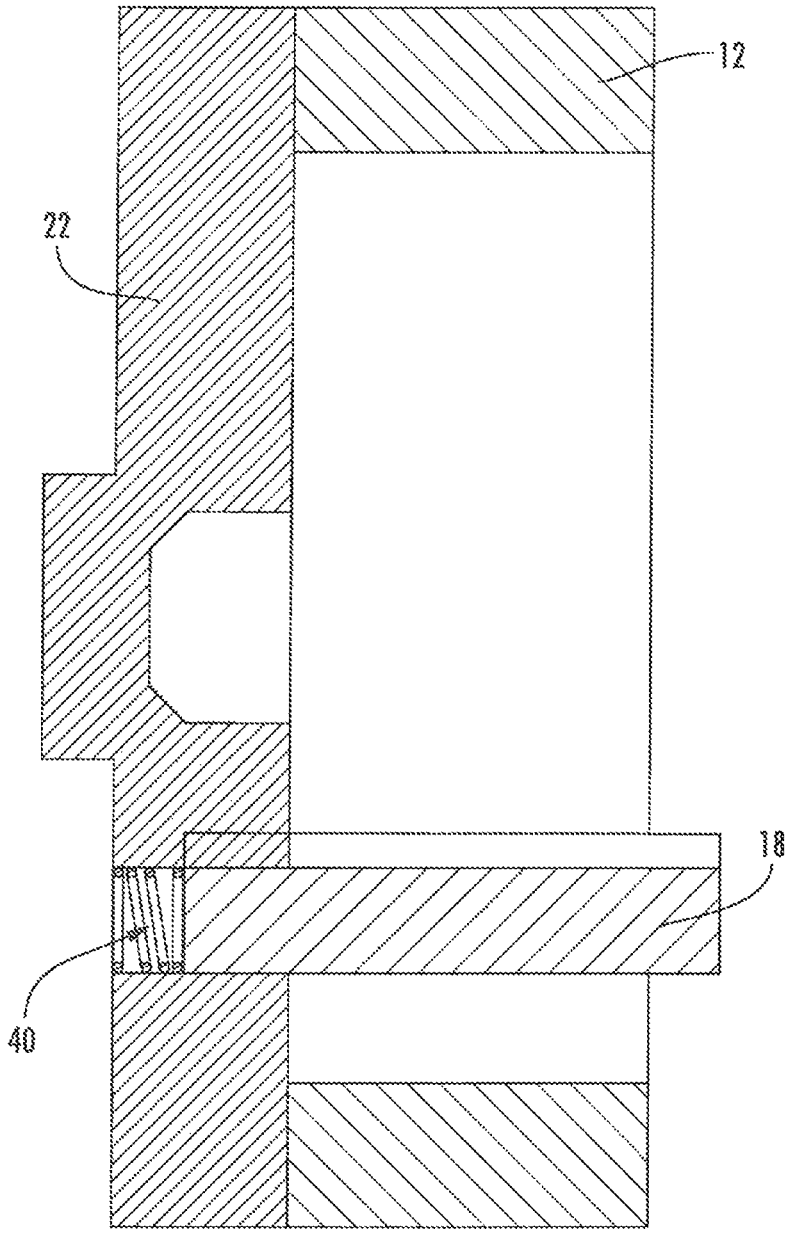
FIG. 6 is a cross-sectional side view illustrating an alternative embodiment of end cover, crescent, and gear housing of the exemplary pump shown in FIG. 1.

In a particular, alternative embodiment of the pump 10 shown in FIG. 6, a biasing member 40 (e.g., a spring) may be disposed within the crescent-shaped slot 32 of the end cover 22. The biasing member 40 may bias the crescent 18 longitudinally forward, thereby forcing the crescent 18 into firm engagement with the front cover 20 and preventing any separation therebetween when the pump 10 is fully assembled.

Figure 5B:
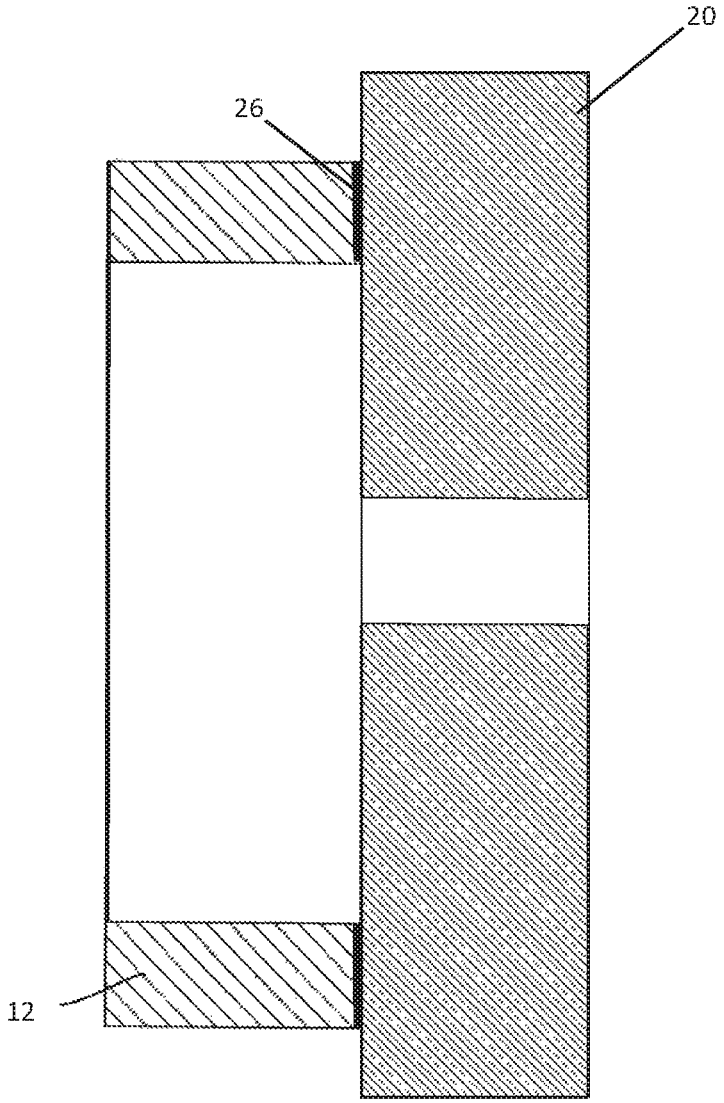
FIG. 5B is a cross-sectional side view illustrating the front cover, shim and gear housing of the exemplary pump shown in FIG. 1.

Referring again to FIG. 1, the shim 26 may be sandwiched between the gear housing 12 and the end cover 22. Alternatively, as shown in FIG. 5B, the shim 26 can be sandwiched between the gear housing 12 and the front cover 20. The thickness of the shim 26 may thereby set the longitudinal clearance between the gear housing 12 and the end cover 22 (or the front cover 20), which in-turn sets the longitudinal clearance between the ring and pinion gears 14, 16 and the front and end covers 20, 22. The precise lengths or thicknesses of the gear housing 12 and the ring and pinion gears 14, 16 are therefore not critical as long as the gear housing 12 and the ring and pinion gears 14, 16 have the same length or thickness "T" (see FIG. 3), which may be easily achieved through match-grinding as further described below. Since shims are inexpensive and are commercially available in standard thicknesses that are tightly controlled, the pump 10 may be manufactured with optimal clearances in a highly repeatable, expedient, and inexpensive manner relative to conventional crescent internal gear pumps that require very precise tolerancing of numerous components.

Figure 7:
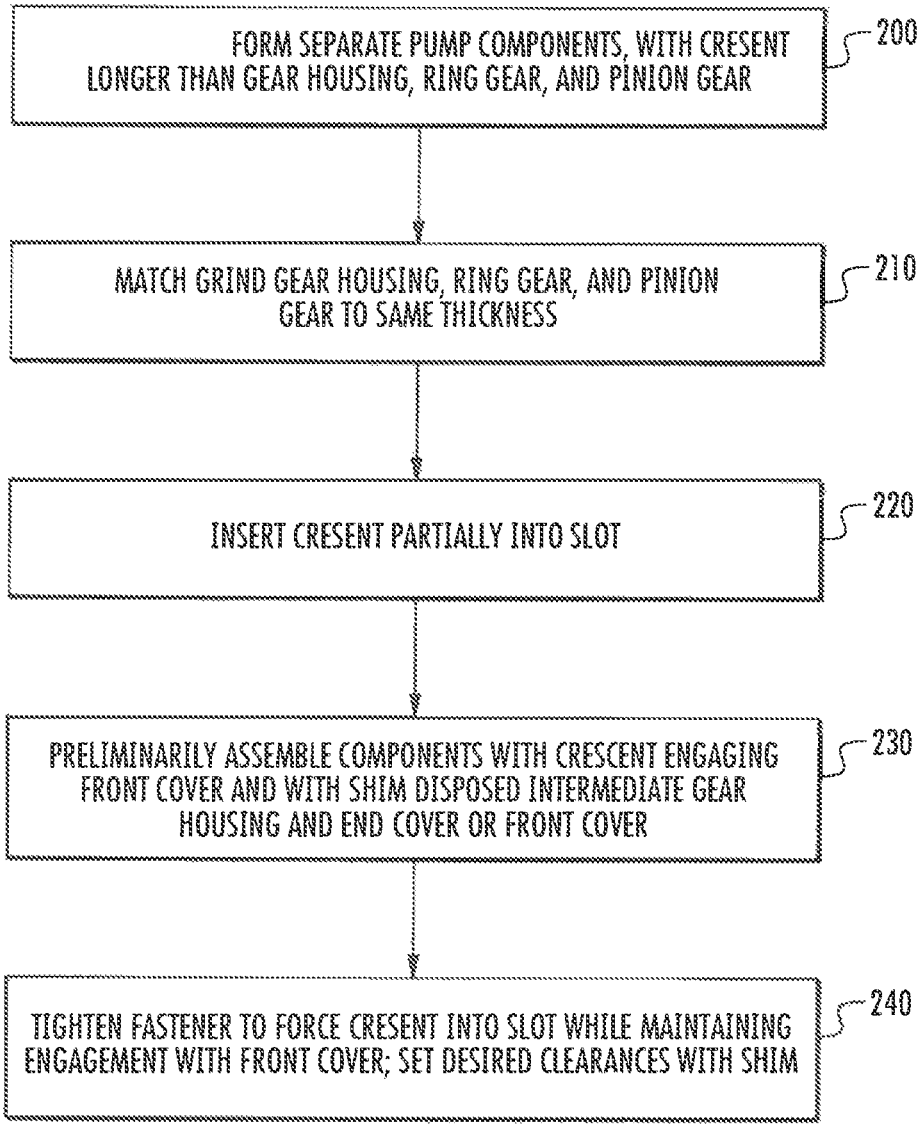
FIG. 7 is a flow diagram illustrating an exemplary method of manufacturing the exemplary pump shown in FIG. 1.

Referring to FIG. 7, a flow diagram illustrating an exemplary method of manufacturing the pump 10 in accordance with the present disclosure is shown. The method will now be described in detail in conjunction with the exploded view of the pump 10 shown in FIG. 1.

In step 200 of the exemplary method, the gear housing 12, ring gear 14, pinion gear 16, crescent 18, front cover 20, and end cover 22 of the pump may be independently formed as separate components, such as by machining each component from a separate piece of metal. Of course, one or more of the components may be formed using various other manufacturing methods, such as casting. During this step, the lengths or thicknesses of the components need not be held to precise tolerances, though the crescent may be made several thousands of an inch longer than the gear housing 12, for example. This application of liberal tolerances reduces the manufacturing cost of the pump 10 relative to conventional crescent internal gear pumps for which very precise tolerances must be maintained. Additionally, since the end cover 22 is formed separately from the gear housing 12 and the crescent 18, the front face of the end cover 22 can easily be made very flat. Forming an end cover with a flat front face is much more difficult in conventional, one-piece crescent plates, since the front face is typically formed by a blind bore.

In step 210 of the exemplary method, the gear housing 12, ring gear 14, and pinion 16 may be match ground to substantially the same thickness using a conventional match grinding process that will be familiar to those of ordinary skill in the art. The precise final thicknesses of the components are not critical as long as they are substantially uniform.

In step 220 of the exemplary method, the crescent 18 may be partially inserted into the crescent-shaped slot 32 of the end cover 22 such that the crescent 18 is still longitudinally moveable in the rearward direction relative to the end cover 22. With the crescent 18 inserted into the crescent-shaped slot 32 thusly, the portion of the crescent 18 that protrudes from the crescent-shaped slot 32 may be slightly longer (e.g., several thousand of an inch to about ⅛ inch longer) than the matched thickness of the gear housing 12, ring gear 14, and pinion gear 16.

In step 230 of the exemplary method, the components of the pump 10 may be assembled in the configuration shown in FIG. 1, with the fasteners 28 being extended through the end cover 22, the shim 26, the gear housing 12, and into engagement with corresponding threaded apertures (not within view) in the front cover 20. Notably, the shim 26 may be disposed intermediate the end cover 22 and the gear housing 12, or, in an alternative embodiment, the shim 26 may be disposed intermediate the gear housing 12 and the front cover 20. With the pump 10 preliminarily assembled thusly (i.e., without the fasteners 28 being tightened), the crescent 18 may be shallowly seated within the crescent-shaped slot 32 and the front face 38 of the crescent 18 may flatly engage the front cover 20.

In step 240 of the exemplary method, the fasteners 28 may be tightened, thereby drawing the components of the pump 10 into secure, longitudinal engagement with one another. As the fasteners 28 are tightened, the front cover 20 may be drawn against the front face 38 of the crescent 18, thereby forcing the crescent 18 longitudinally further into the crescent-shaped slot 32 in a press-fit relationship therewith. Thus, after the fasteners 28 are fully tightened, the front face 38 of the crescent 18 may be disposed in firm engagement with the front cover 20. A leakage path between the crescent 18 and the front cover 20 is thereby avoided without requiring precision tolerancing of the crescent 18 or the gear housing 12. Additionally, the shim 26 automatically sets an optimal longitudinal clearance between the gear housing 12 and the end cover, which in-turn sets an optimal longitudinal clearance between the ring and pinion gears 14, 16 and the front and end covers 20, 22 as discussed above. These optimal clearances are created simply by selecting a shim 26 having a desired thickness, and without requiring precision tolerancing of the gear housing 12, ring gear 14, or crescent gear 16.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A method of manufacturing a crescent internal gear pump having a gear housing, a ring gear, a pinion gear, a first cover, a crescent and a second cover, the method comprising:

providing the gear housing, the ring gear, the pinion gear, the first cover, and the second cover as separate components, wherein the gear housing, the ring gear, the pinion gear, the first cover, and the second cover all have the same thickness;

match grinding the gear housing, the ring gear, and the pinion gear to achieve the same thickness; and providing the crescent with a length is greater than the thicknesses of the gear housing, the ring gear, and the pinion gear.

2. The method of claim 1, comprising providing the second cover with a slot shaped to receive the crescent.

3. The method of claim 1, comprising inserting a first portion of the crescent into a correspondingly shaped slot in the second cover, wherein a length of a second portion of the crescent that protrudes from the slot is greater than the thicknesses of the gear housing, the ring gear, and the pinion gear.

4. The method of claim 3, comprising disposing a biasing member in the slot, the biasing member configured to bias the crescent away from the second cover.

5. The method of claim 3, comprising preliminarily assembling the gear housing, the ring gear, the pinion gear, the first cover, and the second cover using fasteners, whereby a front face of the crescent is brought into engagement with the first cover.

6. The method of claim 5, comprising tightening the fasteners to draw the gear housing, the ring gear, the pinion gear, the first cover, and the second cover into secure longitudinal engagement, whereby the first cover forcibly drives the crescent further into the slot.

7. The method of claim 5, wherein the step of preliminary assembling the gear housing, the ring gear, the pinion gear, the first cover, and the second cover further comprises disposing a shim intermediate the second cover and the gear housing.

8. The method of claim 7, comprising selecting the shim with a predetermined thickness to establish a predetermined clearance between the gear housing and the second cover.

9. The method of claim 7, comprising selecting the shim with a predetermined thickness to establish a predetermined clearance between the second cover and the ring and pinion gears and between the first cover and the ring and pinion gears.

* * * * *